US005370315A

United States Patent [19]

Del Gaone

[11] Patent Number: 5,370,315

[45] Date of Patent: Dec. 6, 1994

[54] SPRAY GUN FOR AGGREGATES

[76] Inventor: Peter V. Del Gaone, 117 St. Charles St., Drexel Hill, Pa. 19026

[21] Appl. No.: 138,473

[22] Filed: Oct. 15, 1993

[51] Int. Cl.[5] ..... B05B 7/02; B05B 1/28

[52] U.S. Cl. ..... 239/527; 239/290; 239/124; 239/583

[58] Field of Search ..... 239/124, 125, 526, 527, 239/583, 290; 222/380

[56] References Cited

U.S. PATENT DOCUMENTS

| | | | |
|---|---|---|---|
| 2,345,402 | 3/1944 | Lubbock et al. | 239/125 |
| 2,613,997 | 10/1952 | Ball | 239/125 |
| 2,880,976 | 4/1959 | True . | |
| 3,018,968 | 1/1962 | Levey | 239/124 |
| 3,119,531 | 1/1964 | Jacobs | 222/318 |
| 3,187,956 | 6/1965 | Dawson . | |
| 3,277,868 | 10/1966 | Lockwood et al. . | |
| 3,306,495 | 2/1967 | Wabers . | |
| 3,375,978 | 4/1968 | Rennie | 239/527 |
| 3,504,855 | 4/1970 | Volker | 239/125 |
| 3,587,970 | 6/1971 | Tindall | 239/125 |
| 3,589,610 | 6/1971 | Wahlin | 239/124 |
| 3,606,168 | 9/1971 | Seaman, Jr. . | |
| 3,819,116 | 6/1974 | Goodinge et al. | 239/125 |
| 3,858,761 | 1/1975 | O'Dell | 222/318 |
| 4,106,699 | 8/1978 | Holt | 239/124 |
| 4,124,045 | 11/1978 | Slywka | 222/318 |
| 4,200,207 | 4/1980 | Akers et al. | 222/318 |
| 4,341,329 | 7/1982 | Kuemmerer et al. | 222/380 |
| 4,535,919 | 8/1985 | Jameson | 239/124 |
| 4,875,625 | 10/1989 | Jones | 239/124 |
| 4,907,741 | 3/1990 | McIntyre | 239/583 |
| 5,078,322 | 1/1992 | Torntore | 239/527 |

*Primary Examiner*—Andres Kashnikow
*Assistant Examiner*—Christopher G. Trainor
*Attorney, Agent, or Firm*—Dann, Dorfman, Herrell and Skillman

[57] ABSTRACT

A valve for dispensing liquids having a high content of particulate material through a spray gun operates between open and closed positions which ensures continuous recirculation of at least a portion of the spray material. The spray gun has an inlet nipple and an outlet nipple for the spray material and the valve has a valve element with a hollow interior providing a flow passage for continuous communication between the inlet and outlet nipples. In the open position only a part of the circulating liquid is discharged through the spray nozzle and in the closed position, all of the material is recirculated. The valve element has a forward position which in the open position apportions the flow of liquid between the interior of the nozzle and the interior of the valve element, and a closed position which blocks flow from the inlet nipple to the interior of the nozzle and directs all of the flow through the valve interior to the outlet nipple.

16 Claims, 3 Drawing Sheets

SPRAY GUN FOR AGGREGATES

FIELD OF THE INVENTION

The present invention relates to spray guns and particularly to spray guns adapted for spraying fluid materials which have a high viscosity and/or a high concentration of particulates which may be fibrous and/or abrasive and/or aggregate materials; especially particulate-loaded cement or mortar, such as plaster or conventional stucco or synthetic stucco which is most commonly called exterior insulation finish systems (E.I.F.S).

BACKGROUND OF THE INVENTION

It has been known that in order to provide an effective spray apparatus for materials with a high particulate content, it is necessary to provide means for maintaining a continuous circulation of the particulate-laden liquid both during the periods when the liquid is being sprayed and during intermediate periods when the spray is interrupted. A continuous circulation of liquid serves to maintain the particulate material in suspension within the carrier liquid.

Conventional valving arrangements have proven to be unsatisfactory for fluent materials in which the particulate material is highly abrasive.

SUMMARY OF THE INVENTION

With the foregoing in mind, the present invention provides a novel spraying apparatus which has improved means affording recirculation of the spray liquid which avoids harmful effects from the presence of fibrous or abrasive particles in the spray liquid.

The apparatus of the present invention minimizes the opportunity for the particles of the liquid to lodge in the apparatus and interfere with the operation of the spray gun or cause deterioration of the same.

More specifically, the present invention provides a spraying apparatus having an improved valve construction which affords continuous circulation of spray liquid through the apparatus both when the apparatus is operating to spray the spray liquid and when the apparatus is operative to interrupt the spray of the spray liquid, and at all positions therebetween.

The valve of the present invention has a valve element which cooperates with the inlet for the spray material to provide a shearing action between the valve element and the valve chamber which is effective to disintegrate any particulate material which might lodge between the valve element and the chamber, thereby avoiding inadvertent interruption of the spraying operation.

The valve of the present invention provides facile incremental adjustment of the flow through the spray head for spray liquids having a wide variation in particle content, viscosity, and abrasiveness.

BRIEF DESCRIPTION OF THE DRAWINGS

All of the objectives of the present invention are more fully set forth hereinafter with reference to the accompanying drawings, wherein.

DESCRIPTION OF THE PREFERRED EMBODIMENTS

Figure 1:
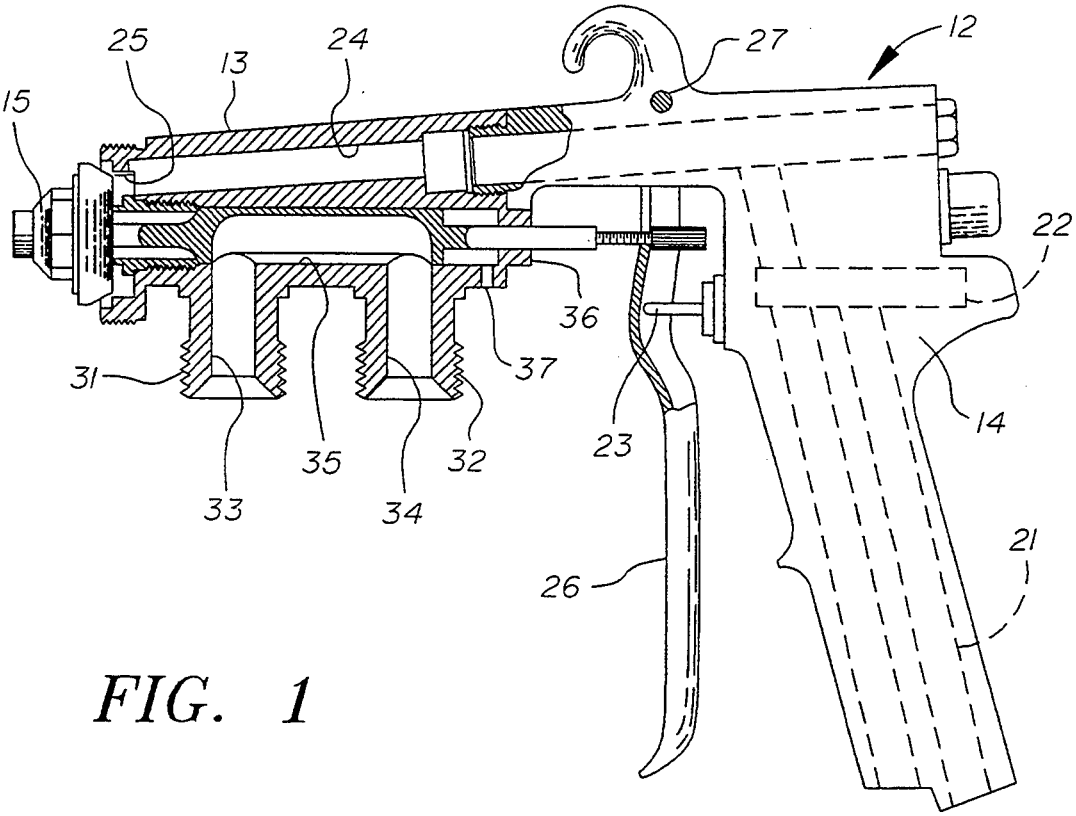
FIG. 1 is an elevational view of a spray gun embodying flow control apparatus for the spraying liquid in accordance with the present invention, the portions of the gun being broken away to illustrate the valve which is in its closed position.

FIG. 1 illustrates a spray gun embodying a flow control valve for the spray fluid made in accordance with the present invention. The gun is designed for dispensing a spray fluid in the form of a liquid aggregate. The spray gun 12 has a barrel 13 and a handhold 14. At the distal end of the barrel 13, a spray nozzle 15 is mounted to discharge the spray fluid in a spray pattern of a selected design. In the present instance, the gun nozzle 15 incorporates peripheral air outlets at 17 which are designed to envelop the spray pattern with a discharge of compressed air. Compressed air is introduced into the nozzle through an air passage 21 and is controlled by a valve 22 having an operator 23 which is selectively operable to introduce compressed air into an air passage 24 in the barrel leading to an air plenum 25 surrounding the nozzle. Actuation of the operator 23 is achieved by trigger 26 pivoted to the barrel at 27 and operable to be pressed toward the handle by either two or four fingers of the operator. The foregoing components are standard operating components of a spray gun, and further description thereof is not deemed necessary.

In accordance with the present invention, means is provided to effect a continuous circulation of spray fluid through the spray gun. In the present instance, the gun is designed to accommodate a spray liquid having carrying particulate material having fibrous and/or abrasive components. To this end, the barrel 13 has an interior axial wall defining an elongated tubular bore forming a valve chamber 35. The barrel is provided with a first nipple 31 for the intake of the spray fluid and a second nipple 32 for the discharge of the spray fluid. In the present instance, the nipples 31 and 32 are positioned adjoining one another in close parallel relation, each nipple having an axialbore 33 or 34 opening into the axial wall of the valve chamber 35 which extends therebetween. The end of the valve chamber proximate the handle 14 is closed, for example by an end wall 36 and is vented as indicated at 37. The distal end of the valve chamber is provided with internal threads 38 to receive the nozzle 15 which has a threaded portion passing through the plenum 25 into engagement with the threaded end 38 of the valve chamber. The hollow interior 54 of the spray nozzle 15 communicates with the valve chamber 35 at its distal end.

Figure 2:
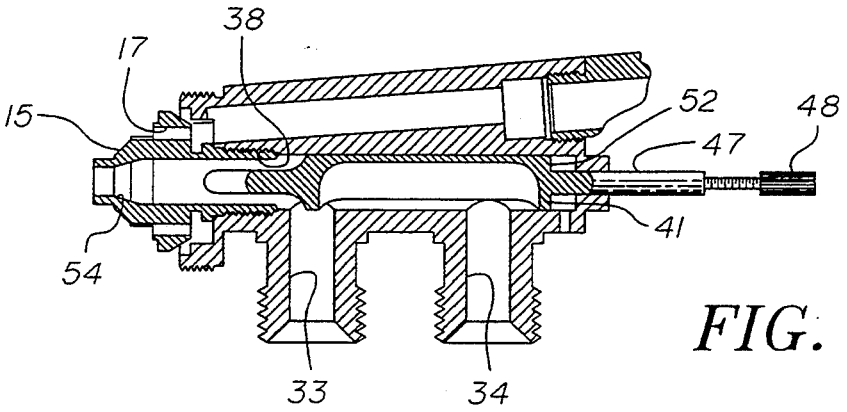
FIG. 2 is a fragmentary view of the gun shown in FIG. 1 showing the valve in its fully opened position.
Figure 3:
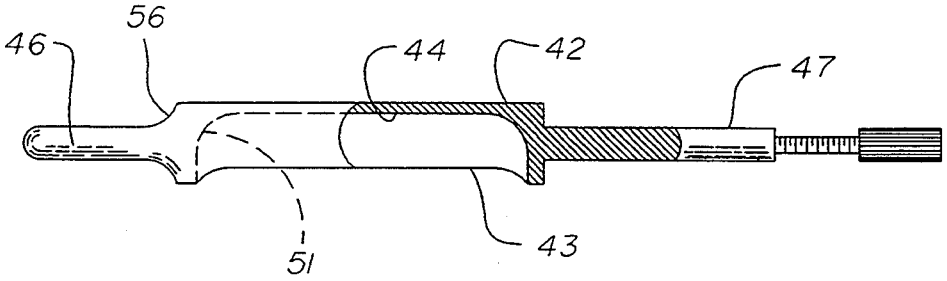
FIG. 3 is an enlarged view of the valve element with portions broken away to show its construction.

A shuttle valve element 41 is positioned for axial displacement in the chamber 35. As shown in FIG. 3, the valve element 41 has a hollow body shell 42. The outside of the hollow shell 42 has a sliding fit with the interior wall of the chamber 35 and has an opening 43 extending along the length of the bottom of the body so as to allow the hollow interior 44 of the body to communicate with the inner ends of the bores 33 and 34. At its forward end, the valve element 41 has a transverse forward partition 51 with a forwarding projecting nose portion 46 which extends into the interior 54 of the nozzle 15 as shown in FIG. 2. At its rear end, the valve element 41 has a transverse rear partition 52 and a rearwardly projecting stem 47 which passes through the end wall 36 and terminates in an operator 48 which is threadedly engaged in the stem 47. The operator is actuated by the trigger 26 by engaging in a slot within the trigger. Thus, as the trigger is operated to open the valve 22 through the operator 23, it also displaces the valve element 41 to the right. When the trigger is actuated, the air line to the passage 24 is opened at the same time as the valve element is moved to the right which effects communication between the inlet bore 33 and the hollow interior of the nozzle 15.

When fully opened, as shown in FIG. 2, the front partition 51 of the valve element is positioned across the middle of the bore 33 so as to divide the flow of the liquid aggregate approximately equally between the hollow interior 44 of the valve element and the hollow interior 54 of the nozzle. The projecting nose 46 of the valve element reduces the flow area through the hollow interior 54 of the nozzle so as to maintain the desired velocity in the liquid discharged into the interior of the nozzle, thereby avoiding a reduction in velocity which might otherwise cause the particulate material in the flow to settle out and accumulate in the hollow interior 54 of the nozzle 15. It is noted that at the base of the nose 46, the cross section of the nose 46 flares smoothly as indicated at 56 into the outer perimeter of the forward partition 51 of the valve element 41 to provide a smooth forward-flow passage. Likewise, the hollow interior 44 of the valve merges into the back of the forward partition 51 and the front of the rear partition 52 to provide a smooth flow passage for the rearward flow. The flow passages through the bore 33, the interior of the shell and the bore 34 are all of approximately the same flow area and devoid of obstructions which could throttle or otherwise interfere with the recirculating flow therethrough.

The present design has been found to enable facile adjustment of the flow from maximum forward flow and a pre-set minimum rearward flow at one limit, and "zero" forward flow and maximum rearward flow at the opposite limit. If it is desired to alter the proportion of flow at the fully opened position, the operator 48 may be adjusted relative to the stem 47. In any event, care must be exercised to ensure a sufficient proportioning of the rearward flow through the valve element and into the outlet to maintain a minimum flow through the spray liquid lines to the inlet 31 and outlet 32 when the valve is fully opened. By maintaining a predetermined minimum flow through the lines, it is possible to use lines of smaller diameter with the result that the volume of spray liquid in the lines is similarly reduced so as to reduce the overall weight of the spray gun during its use. Maintaining the pre-set minimum flow avoids clogging of the line which would be a problem if flow through the line were arrested when the nozzle is open.

Displacement of the valve element causes the partition 51 to sweep across the mouth of the bore 33 in the axial wall of the chamber 35. The outer perimeter of the partition provides sharp edges on opposite side which cooperate with the sharp outline of the mouth to provide a shearing action which severs or disintegrates any particulate matter which might tend to lodge between the valve element and the valve chamber wall across the mouth of the bore 33. This shearing action is particularly effective when the spray liquid carries fibrous particles, as is the case when the spray liquid is fiber-loaded cement or mortar. To achieve this shearing action, the clearance between the sharp edge of the partition and the sharp outline of the mouth should be less than the thickness of the particulate material carried in the spray liquid.

Figure 4:
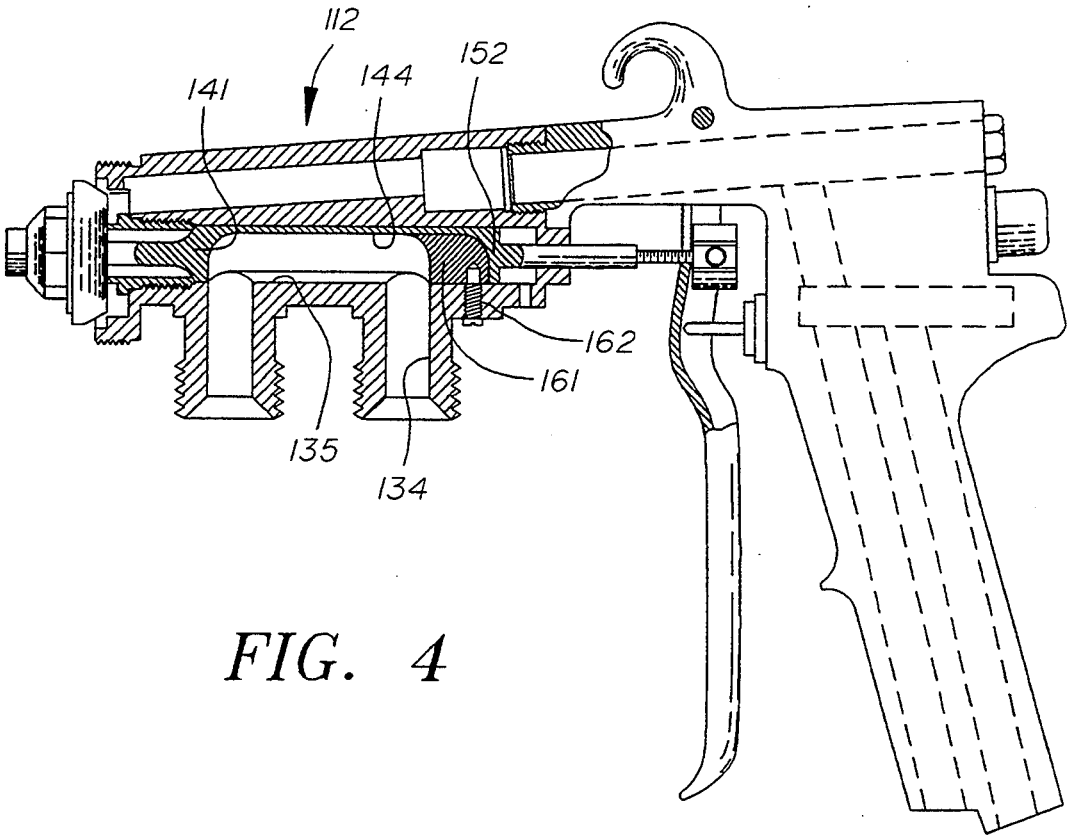
FIG. 4 is a fragmentary view of a modified spray gun having a second embodiment of a valve, the valve being shown in closed position.
Figure 5:
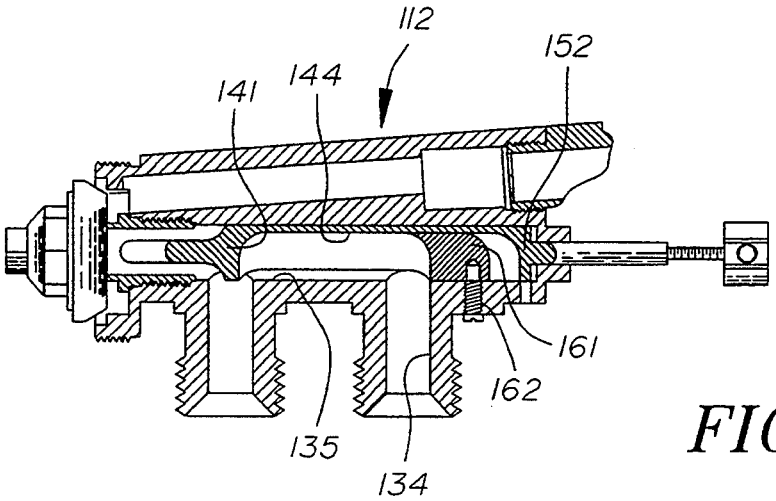
FIG. 5 is a fragmentary view of the gun shown in FIG. 4 with the valve in open position.
Figure 6:
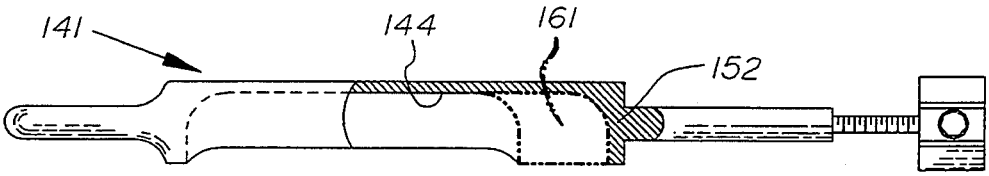
FIG. 6 is an elevational view of the valve element of FIG. 5 with portions broken away and showing the stator component of the gun in broken lines.

FIGS. 4, 5 and 6 illustrate an alternative construction which may be desired for use with the liquids having a high tendency to effect precipitation of particulate matter. FIG. 4 illustrates a modified construction of a gun housing 112 in which the valve chamber 35 of the embodiment of FIG. 1 is modified as shown at 135 to accommodate a longer valve element 141. The hollow interior 144 of the valve element 141 is extended axially to the rear towards the handle to accommodate a stator plug 161 slidable within the hollow 144 of the valve element and which is fixed in position within the chamber 135 by a anchoring element 162. The stator plug 161 provides a transverse stator surface which is fixedly mounted in registry with the far side of the outlet bore 134, and allows the valve element 141 to be displaced towards the handle without leaving a pocket between the rear partition 152 of the valve element 141 and the rear edge of the port connecting the bore 134 of the outlet nipple with the chamber 135. It should be noted that in FIG. 2 there is a pocket formed when a rear wall 52 of the valve element is displaced to the open position. The stator surface is flared to merge into the interior surface of the shell forming the hollow interior 144.

In other respects, the valve element 141 is similar in function and construction to the valve element 41 of the embodiment of FIGS. 1–3.

Figure 7:
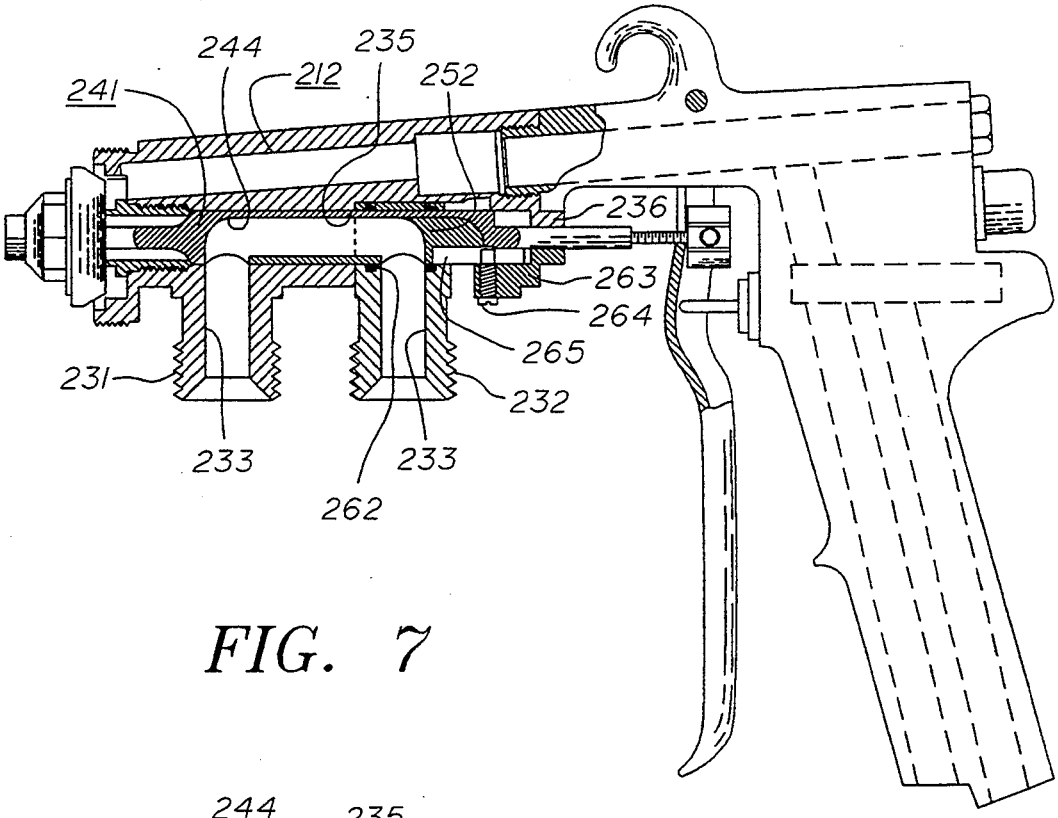
FIG. 7 is a view similar to FIG. 4 of a further embodiment of a spray gun embodying the present invention with the valve in closed position.
Figure 8:
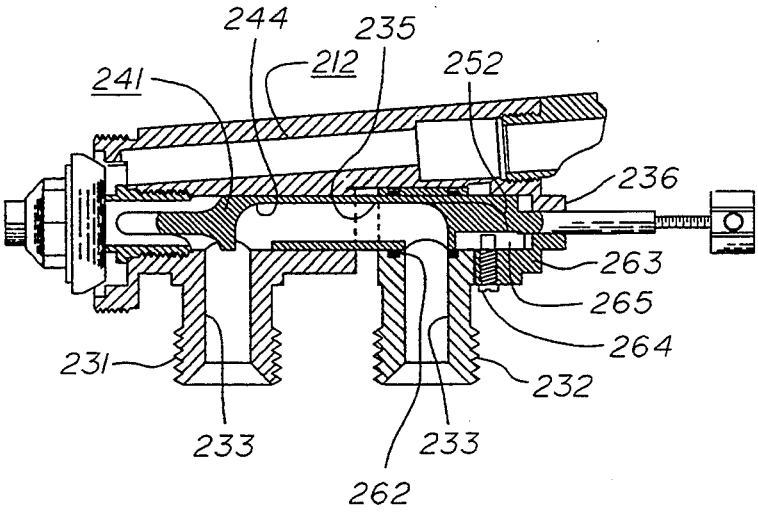
FIG. 8 is a fragmentary view of the apparatus shown in FIG. 7 with the valve in open position.
Figure 9:
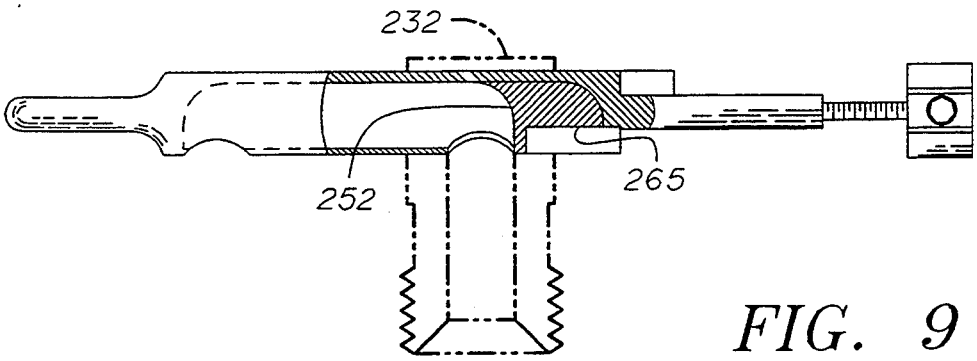
FIG. 9 is a view of the valve element with portions broken away and showing the movable return outlet in dot-and-dash lines.

FIGS. 7–9 illustrate another embodiment of the invention which avoids the formation of a pocket in the flow path for the recirculating material. To this end, FIG. 7 illustrates a modified construction embodying a valve element 241 similar in configuration and function to the elements 41 and 141. In this embodiment of the invention, a spray gun housing 212 is provided with a fixed inlet nipple 231 having an inlet bore 233 and a movable outlet nipple 232 having an outlet bore 234. The movable outlet nipple 232 is mounted on the modified valve element 241 to register with the interior surface of the rear partition 252 of the hollow 244 of the valve element. In the present instance, the nipple 232 is removably mounted on the valve element with seals 262 and a set screw (not shown). Thus, as the valve is displaced between its closed and open positions, the nipple 232 moves with the valve element 241 as shown in FIGS. 7 and 8. The contoured surface rear partition 252 is fixed in alignment with the bore 234 to provide a smooth flow passage for the recirculating liquid aggregate. To provide a sliding support for the proximate handle end of the valve element, the end wall 236 of the valve chamber 235 is provided with a bottom support 263 having an upstanding guide element 264 adapted to engage in a guideway 265 in the handle end of the valve element. The guide 264 and guideway 265 restrict rotation of the valve element 241 as it is actuated between its open and closed positions. As with the valve element 141, the element 241 is similar in configuration and function to the valve element 41.

It is noted that the hollow interior of the valve element in all three embodiments of the present invention provides a smooth flow passage which is approximately equal in flow area to the flow passages provided through the bores of the inlet and outlet nipples. The transverse inner walls of the partitions at the opposite ends of the valve element merge into the interior axial wall of the hollow with a gradual flare as shown. In this way, the valve element avoids any substantial throttling or disruption of the flow of the spray liquid introduced through the inlet nipple, enabling the spray liquid to be pumped to and through the spray gun at the desired flow rate without being substantially affected by opening and closing the valve.

The guns illustrated in the drawings are suitable for spraying liquid aggregates which have a relatively high viscosity and/or a high particle content. The spray liquid flows through the valve chamber and the nozzle without excessive leakage or infiltration of the spray liquid into the operating parts of the gun. For aggregates with discrete particles, it has been found that the clearance between the valve element and the valve chamber wall should be less than the size of the particles, so that when the valve element is at rest, the particles serve to block the flow of the spray aggregate through the clearance spaces in the assembly. As the valve element moves, the confronting edges disintegrate the particles by a shearing action. The enlarged clearances facilitate the cleansing of the spray apparatus at the end of the day, when the apparatus is flushed with water or another cleaning liquid. For lighter liquids having a greater ability to penetrate into clearance spaces, it may be desirable to provide additional sealing components in the form of auxiliary seals or in the form of leak-resisting coatings or materials for the movable components.

While particular embodiments of the present invention have been herein illustrated and described, it is not intended to limit the invention to such disclosure, but changes and modifications may be made therein and thereto within the scope of the following claims.

I claim:

1. A spray gun for spraying fluent materials which have a high concentration of abrasive components and/or embodying a high particulate content, said gun comprising:

a valve chamber, a spray nozzle connected to said chamber at one end thereof, a spray material outlet at the other end of said chamber, and an inlet intermediate said nozzle and said outlet for receiving the spray material under pressure;

a valve element displaceable in said chamber between a closed and an open position, said valve element having a hollow interior operable in the closed position to extend between said inlet and said outlet, said hollow interior being in fluid communication with both said inlet and said outlet, said inlet and said outlet and said hollow interior of the valve element each having a flow passage affording flow of the spray material through said inlet into said hollow interior of the valve element and out through said outlet;

said valve element in the open position operable to split the flow through said inlet into a first partial flow through the hollow interior of the valve element and out of said hollow interior and said valve chamber through said outlet, and a second partial flow through the spray nozzle, whereby the flow through said outlet is uninterrupted when said inlet is receiving the spray material under pressure.

2. A spray gun according to claim 1 wherein said valve element is adjustable incrementally from said closed position to a fully open position, in said fully open position said flow being apportioned approximately equally between the hollow interior of the valve element and the spray nozzle.

3. A spray gun according to claim 1 wherein said valve element has a valve stem extending rearwardly out of said valve chamber, said stem having an operator for displacing the valve element, said spray gun including a trigger cooperable with said operator to displace said valve incrementally between said closed and open positions.

4. A spray gun according to claim 3 including means to adjust said operator relative to said stem, whereby the open position of said valve element is adjustable.

5. A spray gun according to claim 3 wherein said spray gun includes means to supply compressed air to said spray nozzle and an air valve controlling the flow of the compressed air, said air valve having an operator coupled to said trigger whereby said compressed air is supplied to said nozzle concurrently with the displacement of said valve element to the open position.

6. A spray gun according to claim 1 wherein said valve element includes a nose extending along the length of said chamber and operable to project into said spray nozzle effective to reduce the flow area through said valve chamber between said valve element and said nozzle for maintaining the velocity of the spray material during its passage from said inlet to said nozzle.

7. A spray gun for spraying fluent materials which have a high concentration of abrasive components and/or embodying a high particulate content, said gun comprising:

a valve chamber, a spray nozzle connected to said chamber at one end thereof, a spray material outlet at the other end of said chamber, and an inlet intermediate said nozzle and said outlet for receiving the spray material under pressure;

a valve element displaceable in said chamber between a closed and an open position, said valve element having a hollow interior operable in the closed position to extend between said inlet and said outlet and being in fluid communication with both said inlet and said outlet, said inlet and said outlet and said hollow interior of the valve element each having a flow passage affording flow of the spray material through said inlet into said hollow interior of the valve element and out through said outlet;

said valve chamber having an interior axial wall defining an elongated tubular bore within the body of said gun, said inlet providing a spray inlet opening into said interior wall, said valve element having a front transverse partition at one axial end of said hollow interior with an outline conforming to and slidable within said tubular bore between a closed position at the nozzle side of said spray inlet opening and an open position intersecting said spray inlet opening, whereby in said open position said front partition apportions the flow through said spray inlet opening between a first partial flow through said hollow interior of the valve element and through said outlet of the chamber, and a second partial flow through said spray nozzle, whereby the flow through said outlet is uninterrupted when said inlet is receiving the spray material under pressure.

8. A spray gun according to claim 7 wherein said spray inlet opening is defined by a mouth having a sharp outline, and the perimeter of said front partition has sharp edges on its opposite sides which cooperate with the sharp outline of the mouth to provide a shearing action upon displacement of said valve element from the open position toward the closed position.

9. A spray gun according to claim 8, wherein said particulate content comprises particles having a thickness greater than a given dimension, the valve element providing a clearance space between said sharp edges and said sharp outline which is no greater than said given dimension, whereby displacement of said valve element produces a shearing action disintegrating the particles which may be positioned between either of said sharp edges and said sharp outline.

10. A spray gun according to claim 9 wherein said clearance space is sufficiently large to allow a cleansing liquid to flow therethrough when the gun is flushed.

11. A spray gun according to claim 7 wherein said front partition of said valve element has a nose projecting away from the hollow interior of the valve element, in the closed position said nose being positioned within the interior of said spray nozzle and operable to be retracted with movement of said valve element toward said open position.

12. A spray gun according to claim 7 wherein said outlet is in said interior axial wall and is in communication with the hollow interior of said valve element continually as said valve element is displaced axially of said tubular bore between the closed position and the open position.

13. A spray gun according to claim 12 wherein the valve element has an axial peripheral shell, said gun including a transverse stator surface fixedly mounted relative to said outlet within said hollow interior, said transverse fixed surface having a flare merging into the axial interior surface of the shell of said valve element.

14. A spray gun according to claim 7 wherein the valve element has a peripheral shell and a rear transverse partition at the opposite axial end of said hollow interior of the valve element, the inwardly-facing surfaces of said forward and rear transverse partitions being flared into the peripheral shell of said hollow interior so as to provide a streamlined flow path for the spray material flowing through said hollow interior.

15. A spray gun for spraying fluent materials which have a high concentration of abrasive components and/or embodying a high particulate content, said gun comprising:

a valve chamber, a spray nozzle connected to said chamber at one end thereof, a spray material outlet at the other end of said chamber, and an inlet intermediate said nozzle and said outlet for receiving the spray material under pressure;

a valve element displaceable in said chamber between a closed and an open position, said valve element having a hollow interior operable in the closed position to extend between said inlet and said outlet and being in fluid communication with both said inlet and said outlet, said inlet and said outlet and said hollow interior of the valve element each having a flow passage affording flow of the spray material through said inlet into said hollow interior of the valve element and out through said outlet;

said valve element in the open position operable to split the flow through the inlet into a first partial flow through the hollow interior of the valve element and through said outlet, and a second partial flow through the spray nozzle, whereby the flow through said outlet is uninterrupted when said inlet is receiving the spray material under pressure;

the flow passages of said inlet, of said hollow interior of the valve element, and of said outlet all providing substantially the same flow area.

16. A spray gun for spraying materials with a particulate content comprising particles having a thickness greater than a given dimension, said gun comprising:

a valve chamber, a spray nozzle connected to said chamber at one end thereof, a spray material outlet at the other end of said chamber, and an inlet intermediate said nozzle and said outlet for receiving the spray material under pressure;

a valve element displaceable in said chamber between a closed and an open position, said valve element having a hollow interior operable in the closed position to extend between said inlet and said outlet and being in fluid communication with both said inlet and said outlet, said inlet and said outlet and said hollow interior of the valve element each having a flow passage affording flow of the spray material through said inlet into said hollow interior of the valve element and out through said outlet;

said valve element in the open position operable to split the flow through the inlet into a first partial flow through the hollow interior of the valve element and through said outlet, and a second partial flow through the spray nozzle, whereby the flow through said outlet is uninterrupted when said inlet is receiving the spray material under pressure;

said valve element having a clearance space within said valve chamber which is no greater than said given dimension and being displaceably mounted in said chamber without seals or packings.

* * * * *